US009812247B2

(12) United States Patent
Jeong

(10) Patent No.: US 9,812,247 B2
(45) Date of Patent: Nov. 7, 2017

(54) ELECTRONIC COMPONENT

(71) Applicant: SAMSUNG ELECTRO-MECHANICS CO., LTD., Suwon-Si, Gyeonggi-Do (KR)

(72) Inventor: Dong Jin Jeong, Suwon-Si (KR)

(73) Assignee: SAMSUNG ELECTRO-MECHANICS CO., LTD., Suwon-si, Gyeonggi-Do (KR)

( * ) Notice: Subject to any disclaimer, the term of this patent is extended or adjusted under 35 U.S.C. 154(b) by 0 days.

(21) Appl. No.: 14/937,156

(22) Filed: Nov. 10, 2015

(65) Prior Publication Data

US 2016/0217917 A1 Jul. 28, 2016

(30) Foreign Application Priority Data

Jan. 28, 2015 (KR) ..... 10-2015-0013340

(51) Int. Cl.

| | |
|---|---|
| ***H01F 5/00*** | (2006.01) |
| ***H01F 27/28*** | (2006.01) |
| ***H01F 27/24*** | (2006.01) |
| ***H01F 27/29*** | (2006.01) |
| ***H01F 17/00*** | (2006.01) |
| ***H01F 17/04*** | (2006.01) |

(52) U.S. Cl.

CPC ..... *H01F 27/292* (2013.01); *H01F 17/0013* (2013.01); *H01F 17/04* (2013.01); *H01F 2017/048* (2013.01)

(58) Field of Classification Search

CPC ..... H01F 27/2885; H01F 27/255; H01F 27/2804; H01F 27/292; H01F 17/0006; H01F 17/04; H01F 17/0013; H01F 2017/048

USPC ..... 336/200, 223, 233, 192, 170

See application file for complete search history.

(56) References Cited

U.S. PATENT DOCUMENTS

| | | | | |
|---|---|---|---|---|
| 2001/0030593 | A1* | 10/2001 | Imada | H01F 17/0013 336/200 |
| 2003/0137384 | A1* | 7/2003 | Itou | H01F 17/0013 336/200 |
| 2015/0002256 | A1* | 1/2015 | Bourns | H01F 27/2804 336/84 M |

FOREIGN PATENT DOCUMENTS

| | | | |
|---|---|---|---|
| JP | 10-270256 | A | 10/1998 |
| JP | 2001-118728 | A | 4/2001 |
| KR | 10-2005-0011090 | A | 1/2005 |

* cited by examiner

*Primary Examiner* — Mangtin Lian

(74) *Attorney, Agent, or Firm* — McDermott Will & Emery LLP

(57) ABSTRACT

An electronic component includes a magnetic body; internal coil parts including coil conductors disposed on one surface and the other surface of a support member; and a spacer part disposed between the internal coil parts, wherein the internal coil parts include: first and second internal coil parts embedded in the magnetic body to be spaced apart from each other by a predetermined distance in a thickness direction of the magnetic body; and third and fourth internal coil parts embedded in the magnetic body to be spaced apart from each other by a predetermined distance in the thickness direction and to be spaced apart from the first and second internal coil parts by a predetermined distance in a length direction of the magnetic body, and the spacer part is disposed between the first and second internal coil parts and the third and fourth internal coil parts.

15 Claims, 5 Drawing Sheets

A

B

ELECTRONIC COMPONENT

CROSS-REFERENCE TO RELATED APPLICATION

This application claims the benefit of priority to Korean Patent Application No. 10-2015-0013340 filed on Jan. 28, 2015, with the Korean Intellectual Property Office, the disclosure of which is incorporated herein by reference.

BACKGROUND

The present disclosure relates to an electronic component and a board having the same.

An inductor, an electronic component, is a representative passive element configuring an electronic circuit, together with a resistor and a capacitor, to remove noise therefrom.

In order to decrease an area required for the mounting of passive elements on a printed circuit board, an array-type inductor in which a plurality of internal coil parts are disposed may be used.

SUMMARY

An aspect of the present disclosure may provide an electronic component capable of improving inductance through mutual interference between a plurality of internal coil parts disposed therein and suppressing harmful mutual interference of magnetic fields generated by the plurality of internal coil parts, and a board having the same.

According to an aspect of the present disclosure, an electronic component may include: a magnetic body; internal coil parts including coil conductors disposed on one surface and the other surface of a support member; and a spacer part disposed between the internal coil parts, wherein the internal coil parts include: first and second internal coil parts embedded in the magnetic body to be spaced apart from each other by a predetermined distance in a thickness direction of the magnetic body; and third and fourth internal coil parts embedded in the magnetic body to be spaced apart from each other by a predetermined distance in the thickness direction and to be spaced apart from the first and second internal coil parts by a predetermined distance in a length direction of the magnetic body, and the spacer part is disposed between the first and second internal coil parts and the third and fourth internal coil parts.

BRIEF DESCRIPTION OF DRAWINGS

The above and other aspects, features and advantages of the present disclosure will be more clearly understood from the following detailed description taken in conjunction with the accompanying drawings, in which.

DETAILED DESCRIPTION

Figure 1:
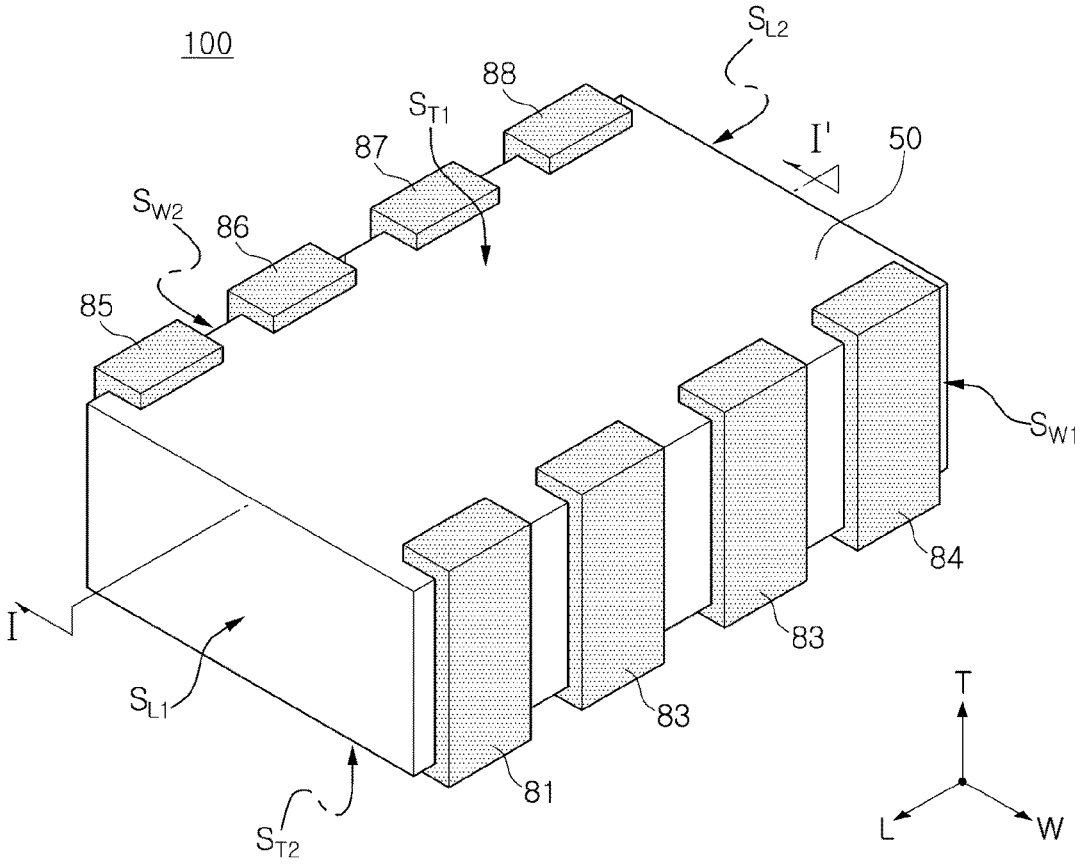
FIG. 1 is a perspective view of an electronic component according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Electronic Component

Hereinafter, an electronic component according to an exemplary embodiment will be described. Particularly, a thin film-type inductor will be described, but the electronic component is not limited thereto.

Figure 2:
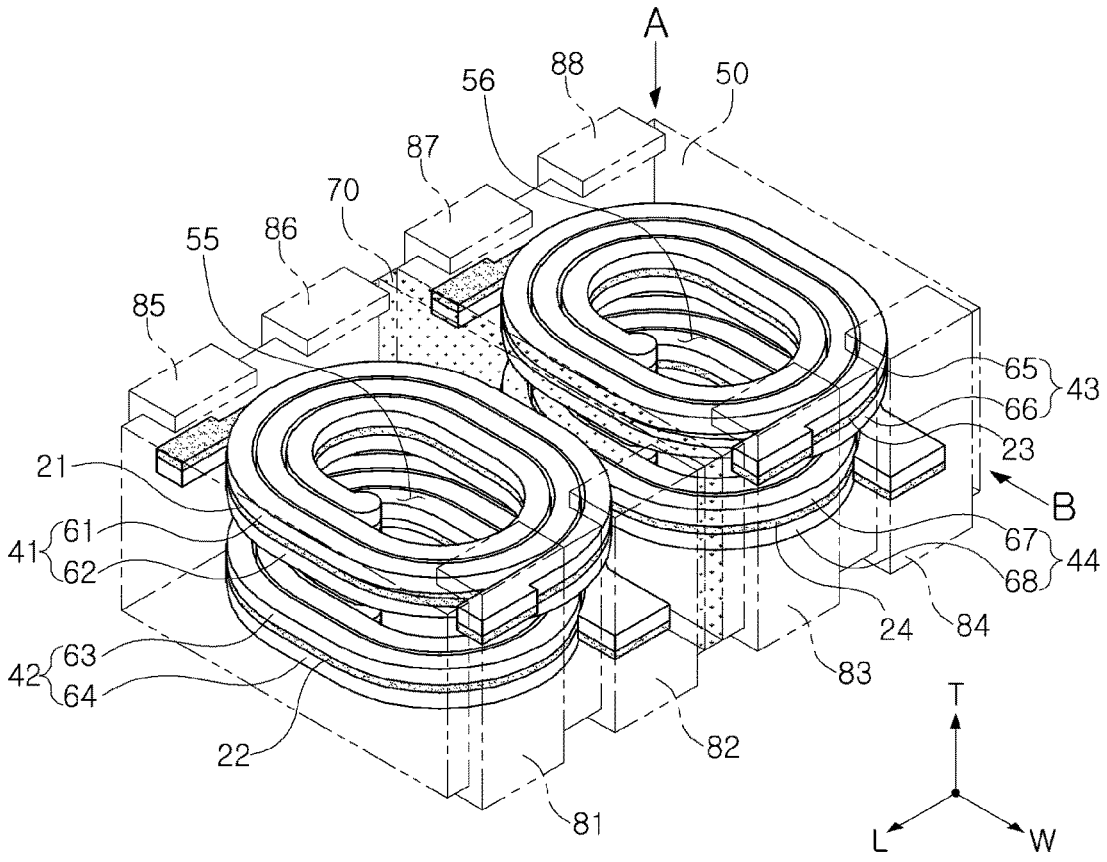
FIG. 2 is a perspective view of internal coil parts in the electronic component according to the exemplary embodiment in the present disclosure.

FIG. 1 is a perspective view of an electronic component according to an exemplary embodiment in the present disclosure, and FIG. 2 is a perspective view of internal coil parts in the electronic component according to the exemplary embodiment.

Referring to FIGS. 1 and 2, as an example of the electronic component, a thin film-type inductor used for a power line of a power supply circuit is disclosed.

An electronic component 100 according to the exemplary embodiment may include a magnetic body 50, first to fourth internal coil parts 41 to 44 embedded in the magnetic body 50, a spacer part 70 disposed between the first and second internal coil parts 41 and 42 and the third and fourth internal coil parts 43 and 44, and first to eighth external electrodes 81 to 88 disposed on external surfaces of the magnetic body 50.

In the exemplary embodiment, ordinal numbers such as "first and second", "first to fourth", and the like, are used in order to distinguish objects, and are not limited to the order thereof.

In the electronic component 100 according to the exemplary embodiment, a 'length' direction refers to an 'L' direction of FIG. 1, a 'width' direction refers to a 'W' direction of FIG. 1, and a 'thickness' direction refers to a 'T' direction of FIG. 1.

The magnetic body 50 may have first and second end surfaces $S_{L1}$ and $S_{L2}$ opposing each other in the length (L) direction thereof, first and second side surfaces $S_{W1}$ and $S_{W2}$ connecting the first and second end surfaces $S_{L1}$ and $S_{L2}$ to each other and opposing each other in the width (W) direction thereof, and first and second main surfaces $S_{T1}$ and $S_{T2}$ opposing each other in the thickness (T) direction thereof.

The magnetic body 50 may contain any material as long as the material exhibits magnetic properties. For example, the magnetic body 50 may contain ferrite or magnetic metal powder.

The ferrite may be, for example, an Mn—Zn-based ferrite, an Ni—Zn-based ferrite, an Ni—Zn—Cu-based ferrite, an Mn—Mg-based ferrite, a Ba-based ferrite, Li-based ferrite, or the like.

The magnetic metal powder may be crystalline or amorphous metal powder containing one or more selected from the group consisting of iron (Fe), silicon (Si), boron (B), chromium (Cr), aluminum (Al), copper (Cu), niobium (Nb), and nickel (Ni).

For example, the magnetic metal powder may be Fe—SI—B—Cr-based amorphous metal powder.

The magnetic metal powder may be dispersed in a thermosetting resin such as an epoxy resin or polyimide, to thereby be contained in the magnetic body 50.

The magnetic body 50 may include the first and second internal coil parts 41 and 42 disposed to be spaced apart from each other by a predetermined distance in the thickness (T) direction and the third and fourth internal coil parts 43 and 44 disposed to be spaced apart from each other by a predetermined distance in the thickness (T) direction and disposed to be spaced apart from the first and second internal coil parts 41 and 42 by a predetermined distance in the length (L) direction.

That is, the electronic component 100 according to the exemplary embodiment may be an array-type inductor having a basic structure in which four or more internal coil parts are disposed in a single electronic component.

The first to fourth internal coil parts 41 to 44 may be formed by connecting first coil conductors 61, 63, 65, and 67, respectively formed on one of the surfaces of first to fourth support members 21 to 24 and disposed to be spaced apart from each other in the magnetic body 50, to second coil conductors 62, 64, 66, and 68, respectively formed on the opposing surfaces of the first to fourth support members 21 to 24.

The first and second coil conductors 61 to 68 may have the form of planar coils formed on the same planes of the first to fourth support members 21 to 24, respectively.

The first and second coil conductors 61 to 68 may have a spiral shape, and the first coil conductors 61, 63, 65, and 67 respectively formed on one surface of the support members 21 to 24, and the second coil conductors 62, 64, 66, and 68 respectively formed on the opposing surfaces of the support members 21 to 24, may be electrically connected to each other by vias (not illustrated) penetrating through the first to fourth support members 21 to 24, respectively.

The first and second coil conductors 61 to 68 may be formed by performing electroplating on the support members 21 to 24, but a method of forming the first and second coil conductors 61 to 68 is not limited thereto.

The first and second coil conductors 61 to 68 and the vias may be formed of a metal having excellent electric conductivity, for example, silver (Ag), palladium (Pd), aluminum (Al), nickel (Ni), titanium (Ti), gold (Au), copper (Cu), platinum (Pt), or alloys thereof.

The first and second coil conductors 61 to 68 may be coated with an insulation film (not illustrated) to thereby not directly contact the magnetic material forming the magnetic body 50.

The first to fourth support members 21 to 24 may be, for example, a polypropylene glycol (PPG) substrate, a ferritic substrate, or a metal-based soft magnetic substrate.

The first to fourth support members 21 to 24 may have through holes penetrating through central portions thereof, wherein the through holes are filled with a magnetic material, thereby forming first and second core parts 55 and 56.

The first core part 55 may be formed inwardly of the first and second internal coil parts 41 and 42, and the second core part 56 may be formed inwardly of the third and fourth internal coil parts 43 and 44.

As the first and second core parts 55 and 56 made of the magnetic material are formed inwardly of the first to fourth internal coil parts 41 to 44, inductance may be improved.

The first and second internal coil parts 41 and 42 may be disposed to be spaced apart from each other by a predetermined distance in the thickness (T) direction of the magnetic body 50, and the third and fourth internal coil parts 43 and 44 may also be disposed to be spaced apart from each other by a predetermined distance in the thickness (T) direction of the magnetic body 50.

The first and second internal coil parts 41 and 42 and the third and fourth internal coil parts 43 and 44 may be disposed in upper and lower portions of the magnetic body 50 of a single electronic component, such that inductance may be improved by mutual interference between upper and lower internal coil parts.

That is, even in a case in which the electronic component is relatively small, high inductance may be obtained through mutual interference between the internal coil parts disposed in the upper and lower portions of the magnetic body 50.

The first and second internal coil parts 41 and 42 may be disposed to be spaced apart from the third and fourth internal coil parts 43 and 44 in the length (L) direction of the magnetic body 50.

The first and second internal coil parts 41 and 42 and the third and fourth internal coil parts 43 and 44 may be disposed to be symmetrical to each other in relation to a central portion of the magnetic body 50 in the length (L) direction, but the first and second internal coil parts 41 and 42 and the third and fourth internal coil parts 43 and 44 are not limited thereto.

The spacer part 70 may be disposed between the first and second internal coil parts 41 and 42 on one side and the third and fourth internal coil parts 43 and 44 on the other side.

Harmful mutual inference of magnetic fields generated by the plurality of internal coil parts disposed at left and right sides of the spacer part 70 may be suppressed by disposing the spacer part 70 between the first and second internal coil parts 41 and 42 and the third and fourth internal coil parts 43 and 44.

In a case of an array-type electronic component in which a plurality of internal coil parts are disposed, malfunctioning of a product may occur and efficiency may be deteriorated due to harmful interference between the internal coil parts.

Further, as electronic components have been miniaturized, a distance between a plurality of internal coil parts embedded in the electronic component has been decreased, such that it may be difficult to suppress harmful interference between the internal coil parts only by adjusting shapes of the internal coil parts and position relationships therebetween.

Therefore, according to the exemplary embodiment in the present disclosure, the harmful mutual inference of the magnetic fields generated by the plurality of internal coil parts may be suppressed by disposing the spacer part 70 between the first and second internal coil parts 41 and 42 and the third and fourth internal coil parts 43 and 44 which are disposed to be spaced apart from each other by a predetermined distance in the length (L) direction of the magnetic body.

That is, the electronic component according to the exemplary embodiment, the array-type inductor in which four or more internal coil parts are disposed, may suppress harmful mutual interference between the magnetic fields generated by the plurality of internal coil parts disposed at the left and right sides by forming the spacer part between the plurality of internal coil parts disposed with a predetermined distance therebetween in the length (L) direction while improving inductance through mutual interference between the internal coil parts disposed in the upper and lower portions of the magnetic body 50.

The spacer part 70 may be formed to cross and isolate a region in which the first and second internal coil parts 41 and 42 are embedded from a region in which the third and fourth internal coil parts 43 and 44 are embedded.

However, the spacer part 70 is not limited thereto, and may have any shape as long as the spacer part 70 may suppress the harmful mutual interference of the magnetic fields generated by the plurality of internal coil parts disposed with a predetermined distance therebetween in the length (L) direction.

The spacer part 70 may be formed of any material as long as the material may suppress the harmful mutual interference of the magnetic fields generated by the first and second internal coil parts 41 and 42 and the third and fourth internal coil parts 43 and 44. In addition, the spacer part 70 may be formed of a material different from that of the magnetic body 50.

The material different from that of the magnetic body 50 may also include a material in which the same raw material is contained but a composition thereof, or the like, is different.

For example, the spacer part 70 may contain one or more selected from the group consisting of a thermosetting resin, a magnetic metal powder, a ferrite, and a dielectric material.

The spacer part 70 formed as described above may have magnetic permeability lower than that of the magnetic body 50, such that the spacer part 70 may suppress harmful mutual interference of the magnetic fields generated by the first and second internal coil parts 41 and 42 and the third and fourth internal coil parts 43 and 44.

The first to fourth internal coil parts 41 to 44 may be connected to the first to eighth external electrodes 81 to 88 disposed on the external surfaces of the magnetic body 50.

The first to eighth external electrodes 81 to 88 may be formed on the first and second side surfaces $S_{W1}$ and $S_{W2}$ of the magnetic body 50 and extended to the first and second main surfaces $S_{T1}$ and $S_{T2}$ of the magnetic body 50 in the thickness (T) direction.

The first to eighth external electrodes 81 to 88 may be disposed to be spaced apart from each other to thereby be electrically separated from each other.

The first to eighth external electrodes 81 to 88 may be formed of a metal having excellent electrical conductivity, for example, silver (Ag), palladium (Pd), aluminum (Al), nickel (Ni), titanium (Ti), gold (Au), copper (Cu), platinum (Pt), or alloys thereof.

Figure 3A:
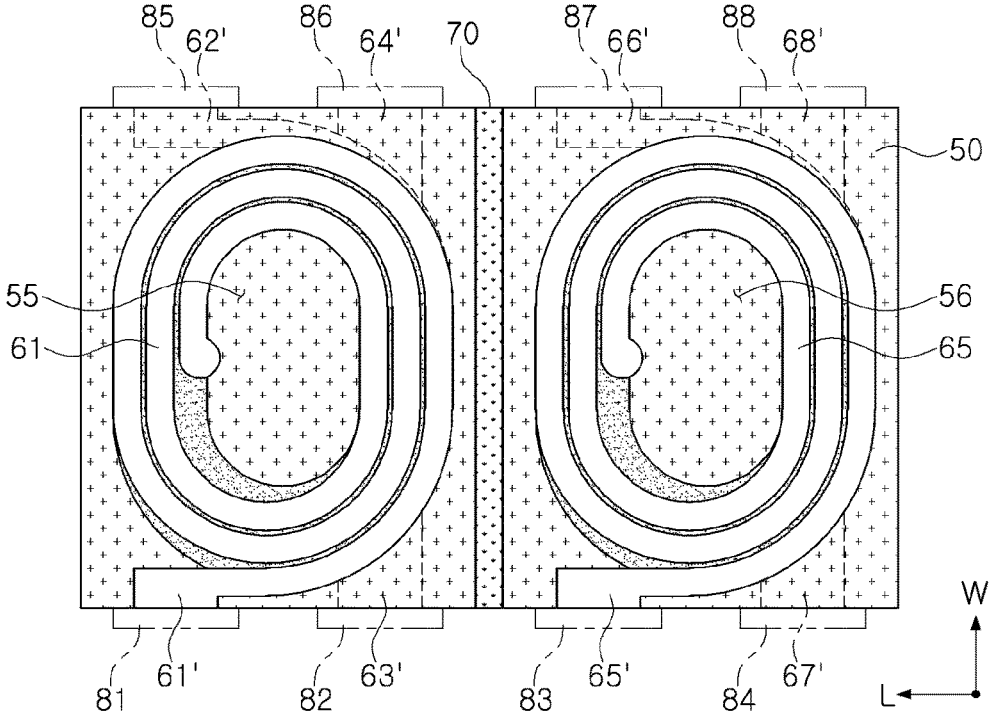
FIGS. 3A and 3B are plan views of an internal portion of the electronic component projected in directions A and B of FIG. 2.
Figure 3B:
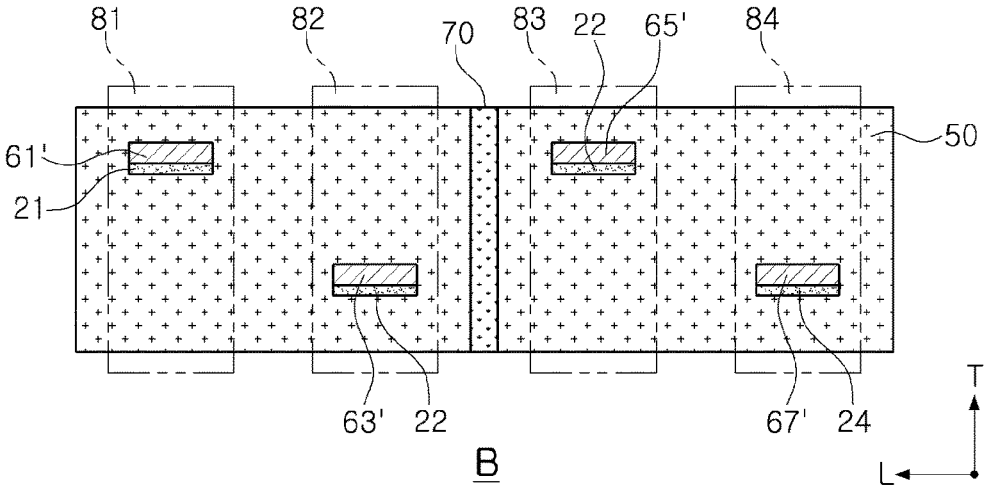

FIG. 3A is a plan view of an internal portion of the electronic component projected in direction A of FIG. 2, and FIG. 3B is a plan view of the internal portion of the electronic component projected in direction B of FIG. 2.

Referring to FIGS. 2 and 3A, the first and third internal coil parts 41 and 43 may include first lead portions 61' and 65' respectively extended from end portions of the first coil conductors 61 and 65 and exposed to the first side surface $S_{W1}$ of the magnetic body 50 and second lead portions 62' and 66' respectively extended from end portions of the second coil conductors 62 and 66 and exposed to the second side surface $S_{W2}$ of the magnetic body 50, respectively.

Meanwhile, the second and fourth internal coil parts 42 and 44 disposed below the first and third internal coil parts and 43 may include first lead portions 63' and 67' respectively extended from end portions of the first coil conductors 63 and 67 and exposed to the first side surface $S_{W1}$ of the magnetic body 50 and second lead portions 64' and 68' respectively extended from end portions of the second coil conductors 64 and 68 and exposed to the second side surface $S_{W2}$ of the magnetic body 50.

The first lead portions 61', 63', 65', and 67' may be connected to the first to fourth external electrodes 81, 82, 83, and 84 disposed on the first side surface $S_{W1}$ of the magnetic body 50, respectively, and the second lead portions 62', 64', 66', and 68' may be connected to the fifth to eighth external electrodes 85, 86, 87, and 88 disposed on the second side surface $S_{W2}$ of the magnetic body 50, respectively.

The first external electrode 81 may be an input terminal, and the fifth external electrode 85 may be an output terminal.

For example, a current input to the first external electrode 81, the input terminal, may sequentially pass through the first coil conductor 61 of the first internal coil part 41, the via, and the second coil conductor 62 of the first internal coil part 41 to thereby flow to the fifth external electrode 85, the output terminal.

Similarly, two external electrodes connected to each of the second to fourth internal coil parts 42 to 44 may be an input terminal and an output terminal, respectively. The current input to the external electrode, the input terminal, may sequentially pass through the first or second coil conductor of the internal coil part, the via, and the second or first coil conductor of the internal coil part to thereby flow to the other external electrode, the output terminal Inductance may be improved by mutual interference between the internal coil parts disposed in the upper and lower portions of the magnetic body 50 by adjusting current flow directions of the internal coil parts disposed in the upper and lower portions of the magnetic body 50.

As illustrated in FIG. 3A, the spacer part 70 disposed between the first and third internal coil parts 41 and 43 disposed with a predetermined distance therebetween in the length (L) direction may be extended from the first side surface $S_{W1}$ of the magnetic body 50 in the width (W) direction to the second side surface $S_{W2}$ thereof. That is, the spacer part 70 may be formed to have a distance in the width direction equal to a width of the magnetic body 50.

Referring to FIG. 3B, the spacer part 70 disposed between the first and second internal coil parts 41 and 42 and the third and fourth internal coil parts 43 and 44 disposed with a predetermined distance therebetween in the length (L) direction may be extended from the first main surface $S_{T1}$ of the magnetic body 50 in the thickness (T) direction to the second main surface $S_{T2}$ thereof. That is, the spacer part 70 may have a thickness equal to a thickness of the magnetic body 50.

Figure 4:
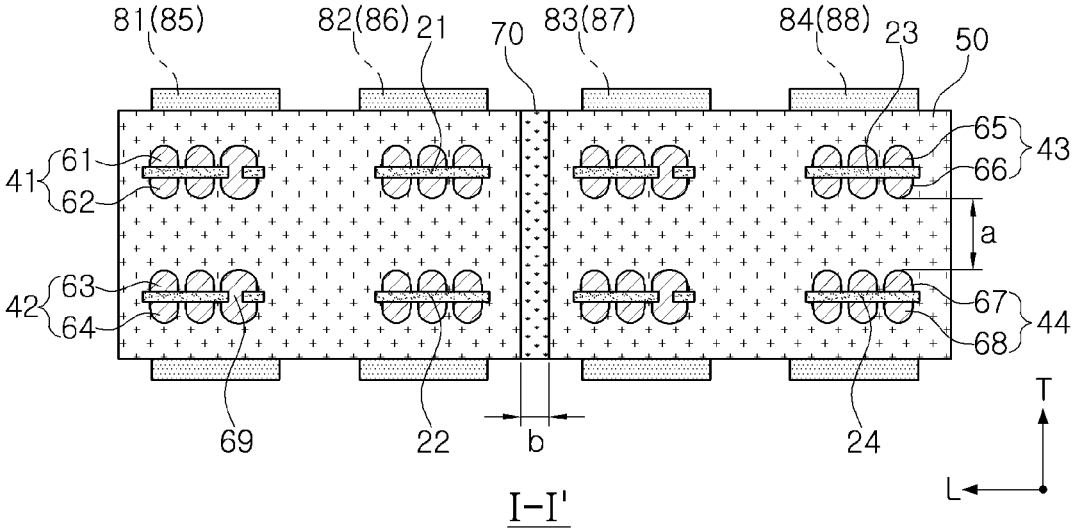
FIG. 4 is a cross-sectional view taken along line I-I' of FIG. 1.

FIG. 4 is a cross-sectional view taken along line I-I' of FIG. 1.

Referring to FIG. 4, the first coil conductors 61, 63, 65, and 67 respectively disposed on one surface of the first to fourth support members 21 to 24 and the second coil conductors 62, 64, 66, and 68 respectively disposed on the opposing surface of the first to fourth support members 21 to 24 may be connected to each other by vias 69 penetrating through the first to fourth support members 21 to 24.

A distance "a" between the first and second internal coil parts 41 and 42 disposed in the upper and lower portions of the magnetic body 50 with a predetermined distance therebetween in the thickness (T) direction may be 10 μm to 150 μm.

In a case in which the distance "a" between the first and second internal coil parts 41 and 42 in the thickness (T) direction of the magnetic body is less than 10 μm, harmful mutual interference between the first and second internal coil parts may occur, and a short-circuit between the first and second internal coil parts may occur, and in a case in which the distance "a" is more than 150 μm, an effect of improving inductance through mutual interference between the first and second internal coil parts may be insufficient.

Similarly, a distance "a" between the third and fourth internal coil parts 43 and 44 disposed in the upper and lower portions of the magnetic body 50 with a predetermined distance therebetween in the thickness (T) direction may be 10 μm to 150 μm.

Various coupling values may be implemented by adjusting a distance between the internal coil parts disposed in the upper and lower portions of the magnetic body 50 with a predetermined distance therebetween in the thickness (T) direction.

A distance in the length direction "b" of the spacer part 70 disposed between the first and second internal coil parts 41 and 42 and the third and fourth internal coil parts 43 and 44 disposed with a predetermined distance therebetween in the length (L) direction of the magnetic body 50 may be 3 μm to 20 μm.

In a case in which the length "b" of the spacer part 70 is less than 3 μm, malfunctioning of a product may occur and efficiency may be deteriorated due to harmful mutual interference of the magnetic fields generated by the plurality of internal coil parts disposed with a predetermined distance therebetween in the length direction, and in a case in which the length "b" of the spacer part 70 is more than 20 μm, the effect of suppressing harmful mutual interference of the magnetic fields may not be significantly increased, but it may be difficult to miniaturize the electronic component.

The coupling values may be controlled by variously changing the width, the length, and the material of the spacer part 70 to adjust mutual interference between the first and second internal coil parts 41 and 42 and the third and fourth internal coil parts 43 and 44.

Figure 5:
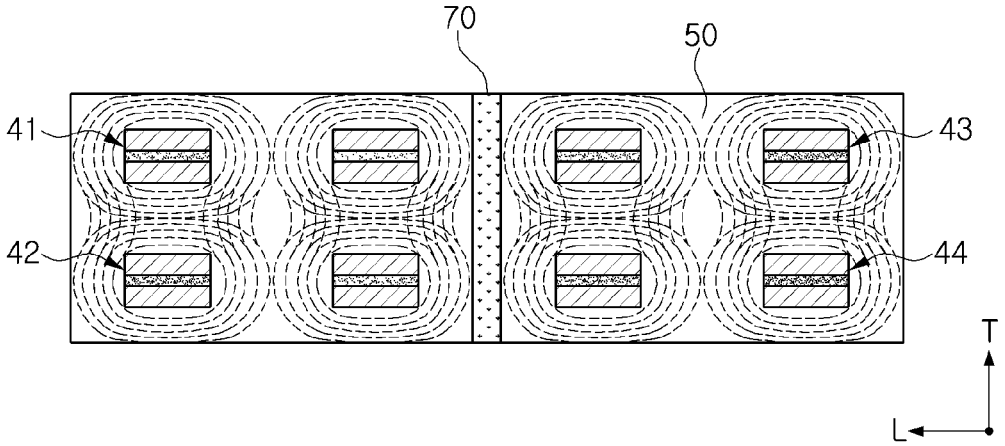
FIG. 5 is a diagram illustrating magnetic fields formed in an electronic component according to an exemplary embodiment in the present disclosure.

FIG. 5 is a diagram illustrating magnetic fields formed in an electronic component according to an exemplary embodiment.

Referring to FIG. 5, it can be seen that mutual interference of the magnetic fields occurs between the first and second internal coil parts 41 and 42 or the third and fourth internal coil parts 43 and 44 disposed in the upper and lower portions of the magnetic body 50 with a predetermined distance therebetween in the thickness (T) direction. Therefore, inductance may be improved.

Meanwhile, it can be seen that harmful mutual interference of the magnetic fields between the first and second internal coil parts 41 and 42 and the third and fourth internal coil parts 43 and 44 may be suppressed by disposing the spacer part 70 between the first and second internal coil parts 41 and 42 and the third and fourth internal coil parts 43 and 44 disposed with a predetermined distance therebetween in the length (L) direction of the magnetic body 50.

That is, the electronic component according to the exemplary embodiment, the array-type inductor in which four or more internal coil parts are disposed, may suppress harmful mutual interference between the magnetic fields generated by the plurality of internal coil parts disposed at the left and right sides by forming the spacer part between the plurality of internal coil parts disposed to be spaced apart from each other by a predetermined distance in the length (L) direction while improving inductance through mutual interference between the internal coil parts disposed in the upper and lower portions of the electronic component.

Board Having Electronic Component

Figure 6:
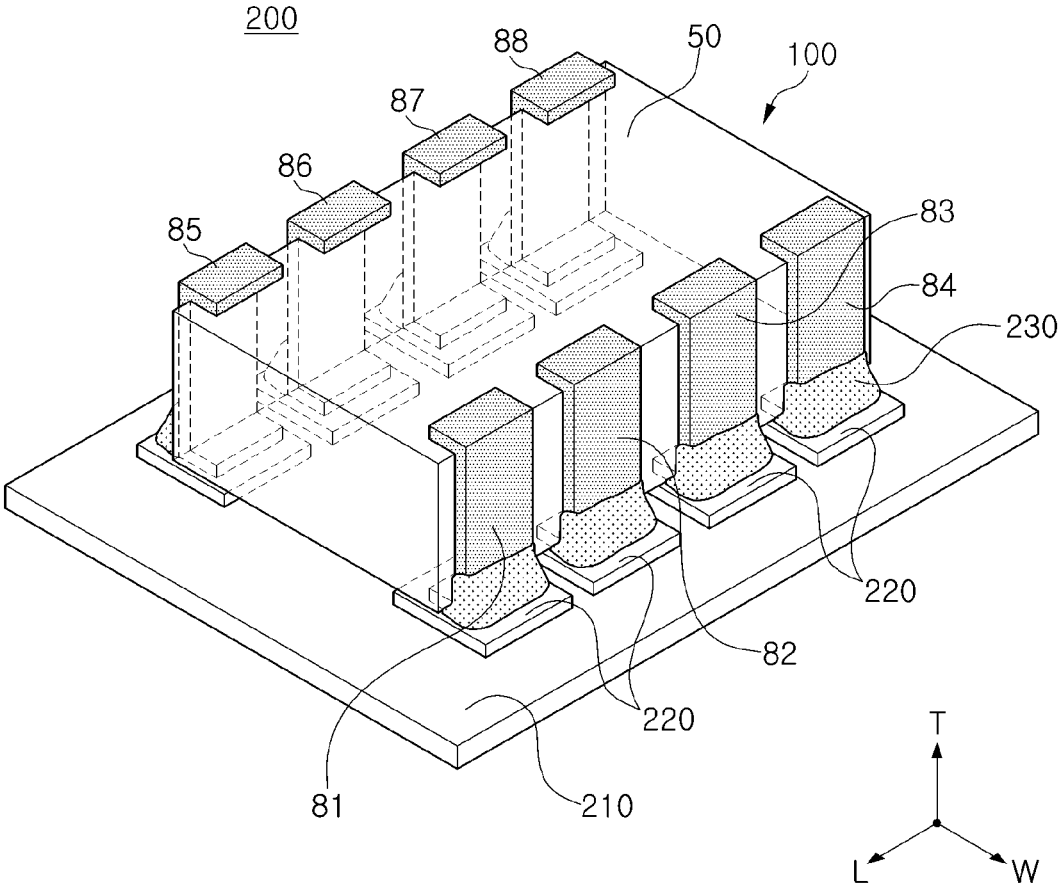
FIG. 6 is a perspective view of a board in which the electronic component of FIG. 1 is mounted on a printed circuit board (PCB).

FIG. 6 is a perspective view of a board in which the electronic component of FIG. 1 is mounted on a printed circuit board (PCB).

Referring to FIG. 6, a board 200 having an electronic component 100 according to the present exemplary embodiment may include a printed circuit board 210 on which the electronic component 100 is mounted and a plurality of electrode pads 220 formed on the printed circuit board 210 to be spaced apart from each other.

In this case, the first to eighth external electrodes 81 to 88 disposed on the external surfaces of the electronic component 100 may be electrically connected to the printed circuit board 210 by solder 230 in a state in which first to eight external electrodes 81 to 88 are positioned to contact the electrode pads 220, respectively.

Except for the description above, descriptions of features overlapping those of the electronic component according to the previous exemplary embodiment will be omitted.

As set forth above, according to exemplary embodiments in the present disclosure, inductance may be improved through mutual interference between the plurality of internal coil parts disposed in the electronic component, and harmful mutual interference of the magnetic fields generated by the plurality of internal coil parts may be suppressed.

Further, the coupling values may be controlled by adjusting mutual interference between the plurality of internal coil parts disposed in the electronic component.

While exemplary embodiments have been shown and described above, it will be apparent to those skilled in the art that modifications and variations could be made without departing from the scope of the present invention as defined by the appended claims.

What is claimed is:

1. A thin film-type electronic component comprising:

a magnetic body;

first and second internal coil parts embedded in the magnetic body and spaced apart from each other by a predetermined distance in a thickness direction of the magnetic body;

third and fourth internal coil parts embedded in the magnetic body and spaced apart from each other by a predetermined distance in the thickness direction, wherein the first and second internal coil parts are spaced apart from the third and fourth internal coil parts by a predetermined distance in a length direction of the magnetic body; and a spacer part disposed between the first and second internal coil parts on one side and the third and fourth internal coil parts on the other side, wherein at least a portion of the spacer part extends continuously from a point above at least one of the first and third internal coil parts in the thickness direction to another point below at least one of the second and fourth internal coil parts in the thickness direction.

2. The thin film-type electronic component of claim 1, wherein the spacer part isolates a region of the magnetic body in which the first and second internal coil parts are embedded from a region of the magnetic body in which the third and fourth internal coil parts are embedded.

3. The thin film-type electronic component of claim 1, wherein the spacer part contains one or more selected from the group consisting of a thermosetting resin, magnetic metal powder, ferrite, and a dielectric material.

4. The thin film-type electronic component of claim 1, wherein the spacer part is formed of a material which is different from a material of the magnetic body.

5. The thin film-type electronic component of claim 1, wherein the predetermined distance between the first and second internal coil parts in the thickness direction is 10 μm to 150 μm.

6. The thin film-type electronic component of claim 1, wherein a distance of the spacer part in the length direction of the magnetic body is 3 μm to 20 μm.

7. The thin film-type electronic component of claim 1, wherein the magnetic body contains a magnetic metal powder and a thermosetting resin.

8. The thin film-type electronic component of claim 1, wherein the internal coil parts each include coil conductors disposed on one surface and the other surface of a support member, and the coil conductors are formed by plating.

9. The thin film-type electronic component of claim 1, wherein the first to fourth internal coil parts each include first and second lead portions respectively exposed to first and second side surfaces of the magnetic body in a width direction of the magnetic body, the first lead portions of the first to fourth internal coil parts are respectively connected to first to fourth external electrodes disposed on the first side surface of the magnetic body, and the second lead portions of the first to fourth internal coil parts are respectively connected to fifth to eighth external electrodes disposed on the second side surface of the magnetic body.

10. The thin film-type electronic component of claim 1, wherein the at least a portion of the spacer part is formed of a composition which is different from a composition of the magnetic body.

11. The thin film-type electronic component of claim 1, wherein the at least a portion of the spacer part is formed of a material which is different from a material of the magnetic body.

12. A thin film-type electronic component comprising:

a magnetic body having first and second end surfaces opposing each other in a length direction thereof, first and second side surfaces opposing each other in a width direction thereof, and first and second main surfaces opposing each other in a thickness direction thereof;

first and second internal coil parts disposed to be spaced apart from each other by a predetermined distance in the thickness direction of the magnetic body;

third and fourth internal coil parts disposed to be spaced apart from each other by a predetermined distance in the thickness direction thereof and disposed to be spaced apart from the first and second internal coil parts by a predetermined distance in the length direction of the magnetic body; and a spacer part disposed between the first and second internal coil parts on one side and the third and fourth internal coil parts on the other side and suppressing mutual interference of magnetic fields generated by the first and second internal coil parts and the third and fourth internal coil parts, wherein at least a portion of the spacer part extends continuously from a point above at least one of the first and third internal coil parts in the thickness direction to another point below at least one of the second and fourth internal coil parts in the thickness direction.

13. The thin film-type electronic component of claim 12, wherein the spacer part has magnetic permeability lower than that of the magnetic body.

14. The thin film-type electronic component of claim 12, wherein the spacer part contains one or more selected from the group consisting of a thermosetting resin, magnetic metal powder, ferrite, and a dielectric material.

15. The thin film-type electronic component of claim 12, wherein the first to fourth internal coil parts each include first and second lead portions respectively exposed to the first and second side surfaces of the magnetic body in the width direction, the first lead portions of the first to fourth internal coil parts are respectively connected to first to fourth external electrodes disposed on the first side surface of the magnetic body, and the second lead portions of the first to fourth internal coil parts are respectively connected to fifth to eighth external electrodes disposed on the second side surface of the magnetic body.

* * * * *